United States Patent [19]

Davis et al.

[11] Patent Number: 4,802,500

[45] Date of Patent: Feb. 7, 1989

[54] PORTABLE COLLAPSIBLE BUILDING SYSTEM OF MODULAR CONSTRUCTION

[76] Inventors: James P. Davis; David W. Henry, both of c/o Miles Yanick & Co., 261 Madison Ave. S., Bainbridge Island, Wash. 98110

[21] Appl. No.: 85,466

[22] Filed: Aug. 14, 1987

[51] Int. Cl.[4] ..... E04H 15/14; E04H 15/48; E04H 15/02

[52] U.S. Cl. ..... 135/97; 135/109; 135/904

[58] Field of Search ..... 135/97, 109, 904

[56] References Cited

U.S. PATENT DOCUMENTS

| | | | |
|---|---|---|---|
| 3,325,206 | 6/1967 | Carlson | 135/904 X |
| 3,724,893 | 4/1973 | Giroux | 135/109 X |
| 3,763,607 | 10/1973 | Glover | 135/109 X |
| 4,057,283 | 11/1977 | Barnett | 135/109 X |
| 4,099,534 | 7/1978 | Corbin | 135/109 X |
| 4,649,947 | 3/1987 | Tury et al. | 135/97 |

FOREIGN PATENT DOCUMENTS

| | | | |
|---|---|---|---|
| 625472 | 8/1961 | Canada | 135/904 |
| 435586 | 5/1967 | Switzerland | 135/109 |
| 738593 | 6/1980 | U.S.S.R. | 135/904 |

*Primary Examiner*—J. Karl Bell

*Attorney, Agent, or Firm*—George M. Cole

[57] ABSTRACT

A portable shelter structure (10) of variable size consisting of an even number of individual, folding, modular units (12) which, in their folded condition, serve as shipping containers for the shelter. Rigid floor and rigid sidewall sections (22, 28) are hinged (24) along an adjacent edge allowing rotation of the sidewall section from a closed position to an upright position so that the sidewall is substantially perpendicular. Collapsible roof support beams (72) and flexible, collapsible roof covering units (14) are stored in a cavity created between the floor (22) and sidewall (28) sections when they are in their closed state. Collapsible end walls (16) having a door structure (17) therein can be stored in the modular unit cavity or in a separate vestibule packing unit (18) which attaches to the end wall as a separate closed space outside the end wall door.

8 Claims, 11 Drawing Sheets

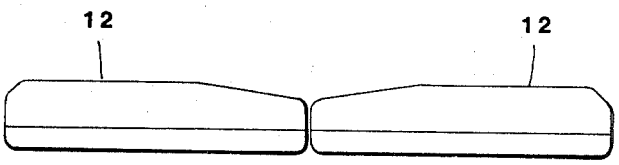
FIG. 10
FIG. 11
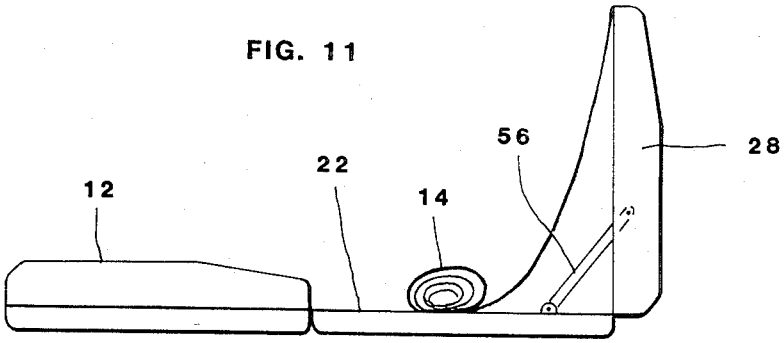

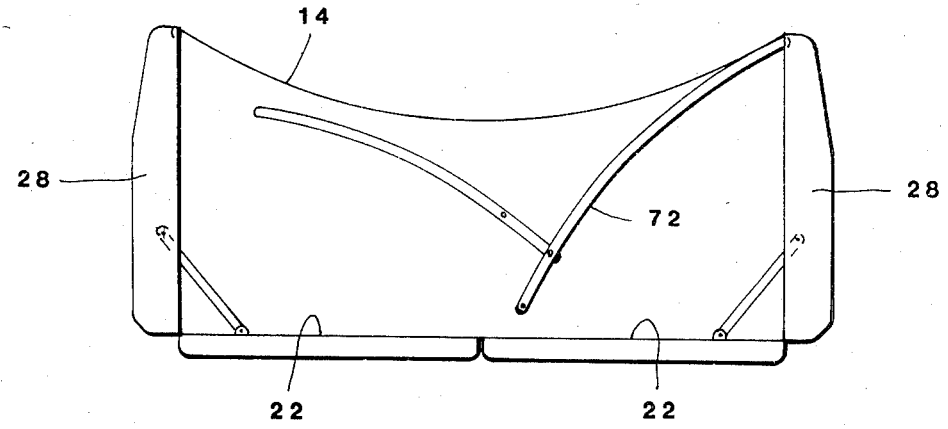
FIG. 12
FIG. 13
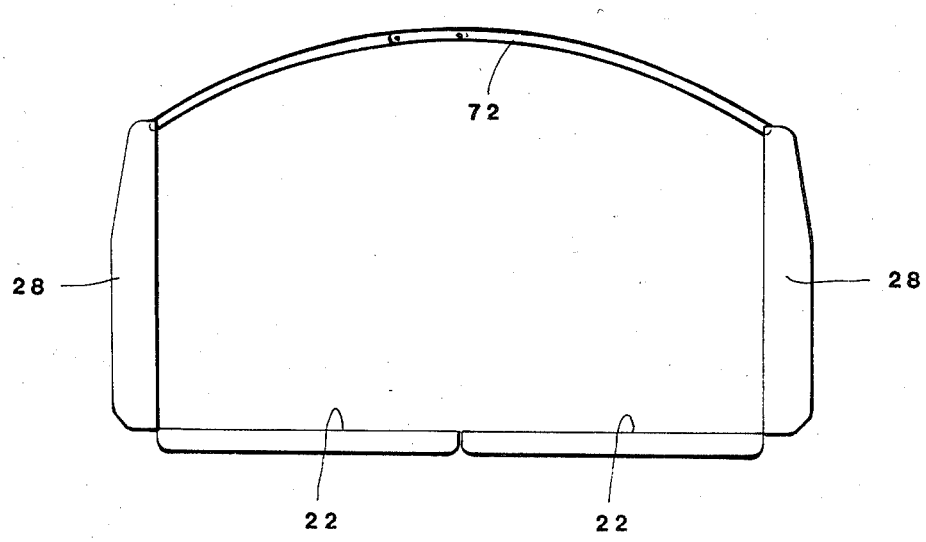

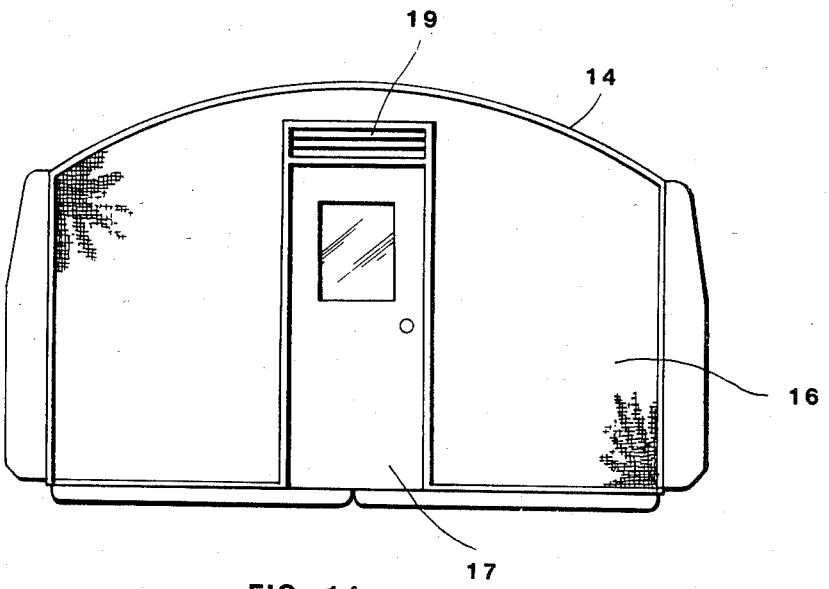
FIG. 14
FIG. 15
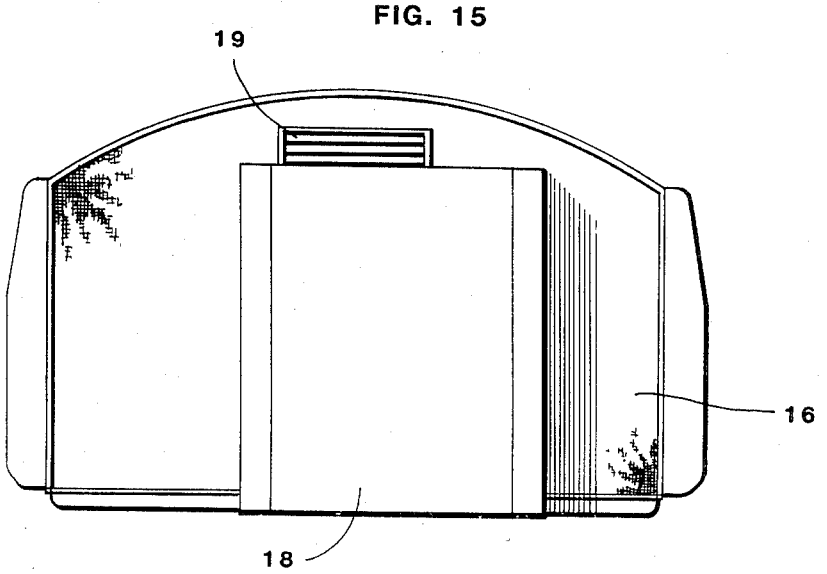

PORTABLE COLLAPSIBLE BUILDING SYSTEM OF MODULAR CONSTRUCTION

TECHNICAL FIELD

The invention relates to the field of portable building systems and more particularly to a modular, collapsible combined floor and sidewall unit which when in its collapsed stage forms a container in which other parts of the structure may be stored and transported.

BACKGROUND ART

The primary factors influencing the design of collapsible, portable building systems are the ease of assembly and disassembly, ease of transport in their collapsed condition and the overall comfort and/or practicality of the shelter for its intended use once it has been erected. There is among presently available designs considerable room for improvement in each of the above characteristics, particularly as they relate to the use of such systems in remote locations under extreme climatic conditions such as high winds, severe temperatures and blowing sand and snow. Known portable and collapsible building systems vary in design from simple tents to complex folding buildings. Typically, one or more of the following problems exists with each of the known designs. The structures may require heavy equipment such as cranes or winches to erect. They may be awkward to transport to remote off-road regions, that is they may be heavy, bulky or of a shape which is not adaptable to a wide variety of transport means. They may be complex and thus time consuming to erect by involving a great number of loose parts in the construction and erection and thereby increasing the chances of equipment failure or the loss of small pieces or items of essential hardware. Another problem is that the structure may simply be ineffective in a hostile environment. Finally, some designs may not be expandable into variable sized buildings which are adaptable to a wide variety of uses.

Among the patented prior art devices of which applicants are aware are the following U.S. Pat.: Nos. 4,534,141; 4,133,149; 4,085,762; 3,971,395; 3,763,607; 3,629,982; 3,421,268; 3,338,003; 3,284,966; 3,103,709; 2,904,850; 2,797,696; 2,765,499; 2,751,635; 2,693,195; 2,632,454; 2,363,917; and 2,363,916. None of the cited prior patents is pertinent in terms of its structure or construction principles to the invention herein other than for isolated features.

DISCLOSURE OF THE INVENTION

The invention comprises a lightweight, substantially weather tight, completely recoverable portable structure which can be assembled from any multiple of two collapsible or folding modular units. The modular units are rigid combination floor and sidewall sections of generally rectangular shape and which are pivotally connected together. The modular units are configured so as to fold into a compact shipping container with an interior cavity or compartment for storing other smaller parts and elements of the structure such as roof members, end wall sections, or compartment for storing other parts and elements of the system such as foldable joist or beam pieces, foldable roof covering blankets, foldable end wall sections, guy lines, stakes and the like. The units are unfolded and assembled in pairs with the floor portions being detachably joined along the centerline of the structure and the sidewall portions being pivoted upwardly to an upright postion. A flexible folding or collapsible and insulated roof covering is spread between and attached to the tops of the side walls and the roof joists are inserted up underneath the roof covering and between the tops of the side walls. Additional modular units may be added edgewise in pairs to give the length of structure desired. End wall sections with access door means are attached. Also included in the system is a collapsible vestibule unit which can be added to the end wall for access door weather protection.

Accordingly it is among the many features and advantages of the design to provide a portable building system of a novel configuration made up of coacting pairs of foldable or collapsible modular units which when collapsed form shipping containers. The units are comparatively light, compact, rugged and durable. The structure can be erected and disassembled quickly with as few as two persons without the aid of any tools or equipment which are not an integral part of the structure. The modular floor/sidewall units are foldable into closed, protective shipping container means of a convenient size, weight and configuration which can be loaded and stacked by hand on a great variety of transport vehicles, including helicopter suspended cargo slings and standard 8′ by 8′ cargo pallets. This novel configuration makes allowances for handling by forklifts, as for example, molded skegs on the floor sections, and by over head cranes as for example by recessed lifting points on the four corners of the modular units. However, the weight and shape of the modular floor/-side wall units in their closed condition does not require the use of such specialized handling equipment for general handling. The interiors of the units can be customized to a variety of specific uses such as galleys or kitchens, sleeping quarters, laboratories, clean rooms for computers, medical facilities, shops, storage areas and the like. The structures are designed to be used through multiple cycles of erecting and collapsing and transporting. The building system structures are weather tight and resist buffeting from high wind forces.

BRIEF DESCRIPTION OF THE DRAWINGS

FIGS. 10–13 illustrate the erection steps for the units, FIG. 14 shows an end wall detail of the structure with a door therein for ingress and egress, FIG. 15 shows an end wall with the vestibule section attached.

BEST MODE FOR CARRYING OUT THE INVENTION

Figure 1:
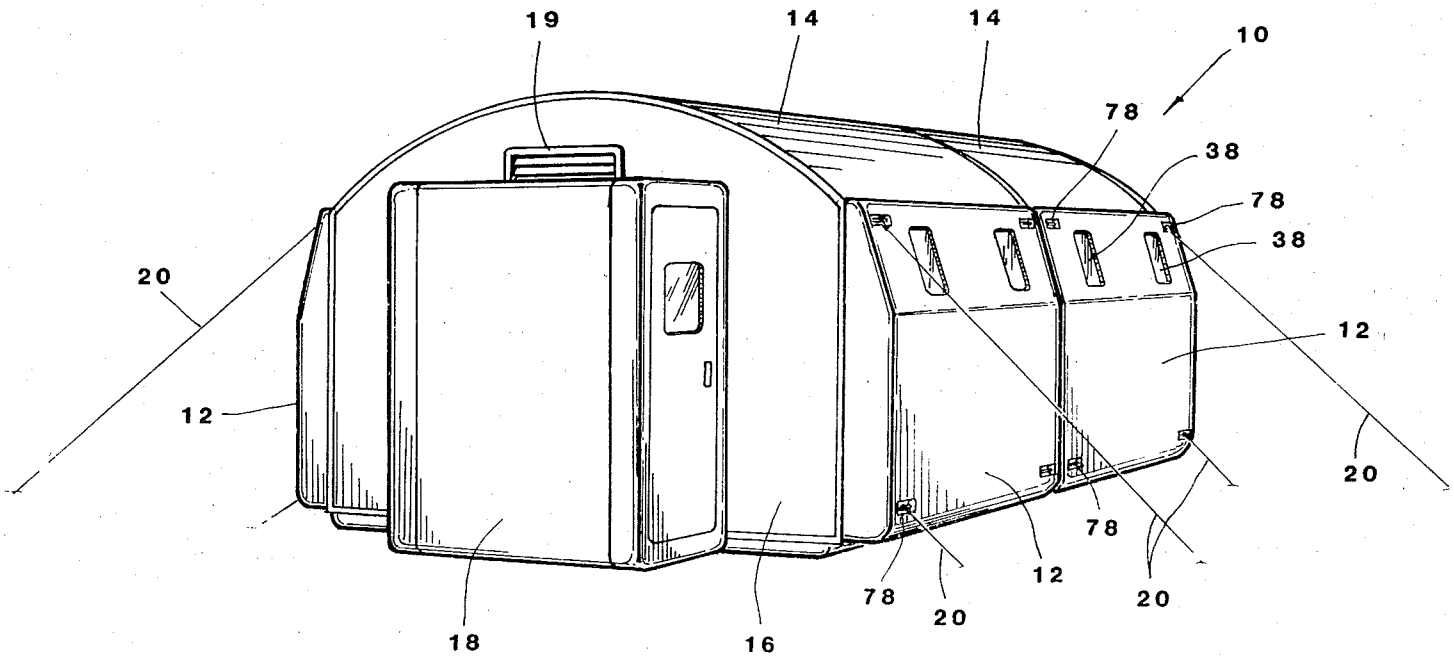
FIG. 1 is a view in perspective of a portable structure erected from and according to the teachings of the invention.

Referring now to the drawings it will be seen that the invention is erectable into a temporary structure shown in FIG. 1 and generally designated by the number 10. The structure 10 is made up of modular combination floor and side wall units generally designated by the number 12, roof sections 14, end wall sections 16 and vestibule sections 18. Guy lines 20 of rope or cable secure the structure against buffeting if it is erected in a high wind environment.

The basic modular construction unit 12, as shown in FIGS. 2 through 9, is a generally rectangularly shaped member having a rigid floor portion 22 pivotally hinged as along one edge at 24 to a concave side wall portion 26. It will be noted that the side wall portion 26 has side edges 28, upper edge 30 and bottom edge 32 along which hinge means 24 extends. The walls of sections 22 and 26 are made of a high "R" factor insulation material such as plastic foam sandwiched between rigid plastic shell material. It is to be understood that there are a number of suitable materials for both wall and floor sections. It will also be appreciated that the side walls can be made of a single layer of plastic or composite material where weight is assigned a priority over insulation value. The configuration takes advantage of but is not limited to the use of light weight plastics and recently invented composite materials. Units 12 have an inside or inner shell or facing 34 and an outside shell or facing 36. Ports or windows 38 are provided optionally and may be made to open and close if desired. Units 12 being concave have an angle surface 40 along the top and a shorter angled surface 42 along the bottom. Thus, the side wall portion 26 has inwardly extending edges along all four sides to define a box-like cavity for which the floor section acts as a lid.

In like manner the floor portion 22 comprises a wall of plastic foam material such as between rigid shell facings 44 and 46 and has ends 48 and 50, inner edge 52 and hinge edge 54. Knee braces 56 are provided to lend stability by holding the floor section with respect to the sidewall floor section. Appropriate joining members 56 are provided along the inner edge 52 to hold pairs of floor portions securely together.

Each unit 12 is provided on the outside edges or periphery with a generally continuous weather groove 60 as is best seen in FIGS. 2, 5, 6, 7 and 9. Groove 60 is formed so as to present a generally continuous overhanging lip 62 the details of which are most easily seen in FIGS. 5, 6 and 7 and which will be discussed in additional detail hereinafter.

Figure 7:
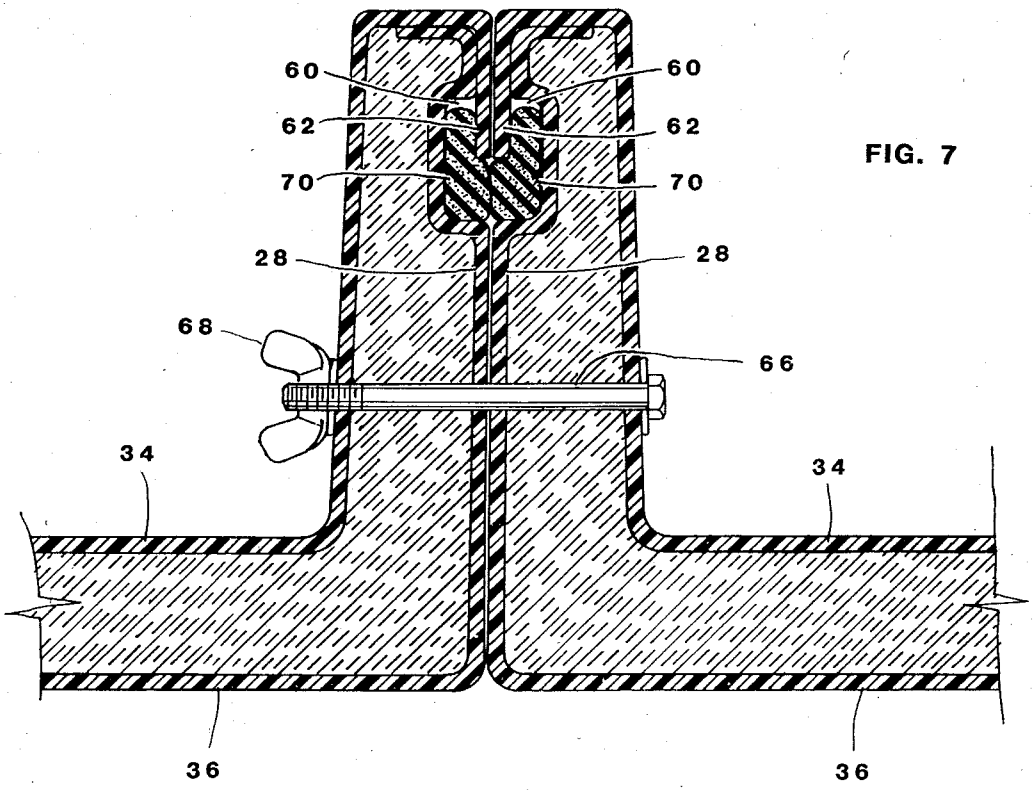
FIG. 7 is a partial view in cross section taken along the line 7—7 of FIG. 6 and showing connection means between abutting edges of modular units.
Figure 8:
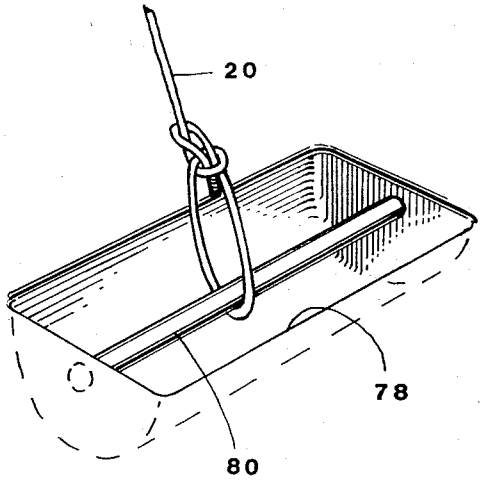
FIG. 8 is a partial view in perspective showing one means for securing guy rope to a unit.

FIG. 7 shows that units 12 are joined together at ends 28 by bolts 66 inserted through holes provided in end edges 28 and tightened by wing nuts 68. A compressible weather stripping material 70 is included in the weather groove 60 so that a weather tight end joining of a second pair of modular units 12 can accomplished. The bolt and wing nut are illustrative only since a wide variety of end edge attachment means may be used if desired. Effectiveness, expense and ease of handling are important in the selection of attachment means employed.

Figure 2:
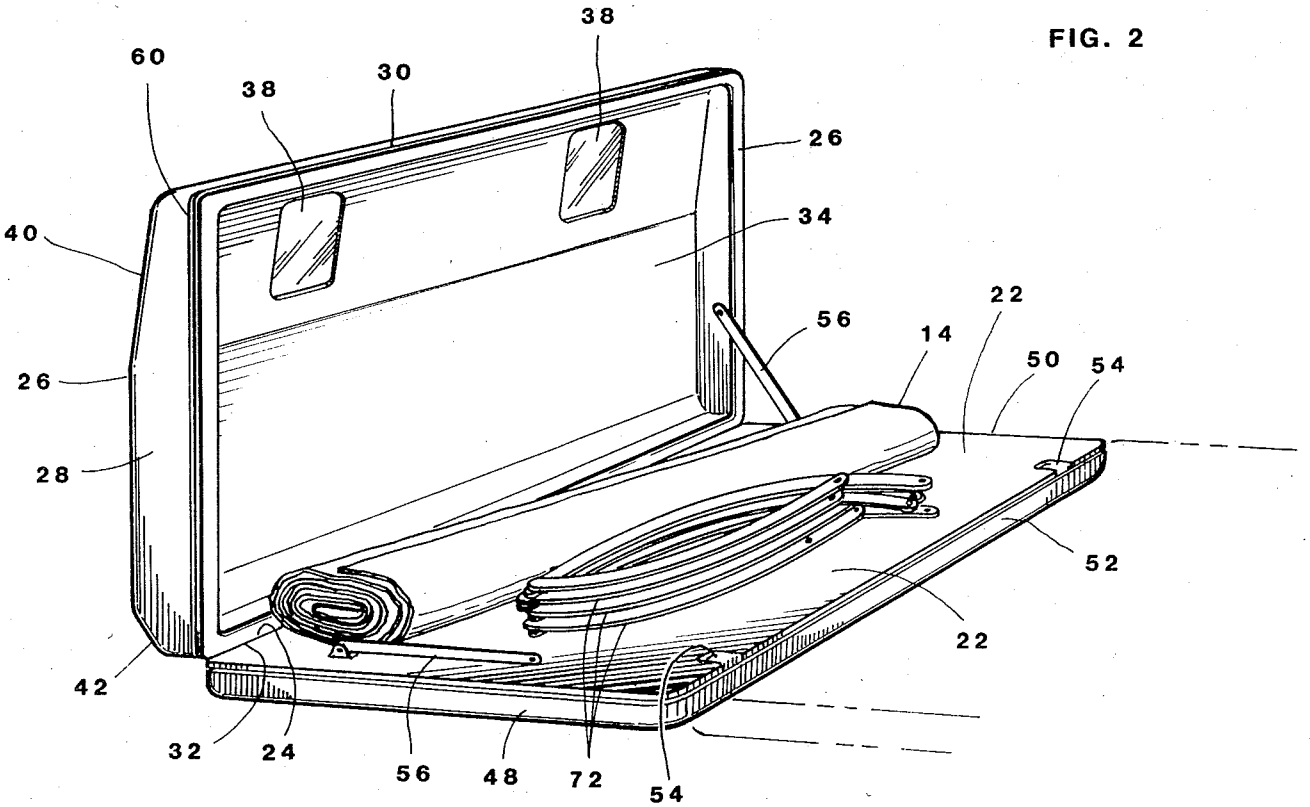
FIG. 2 is a perspective view of one of the modular construction units illustrating its dual function as a transporting container.
Figure 3:
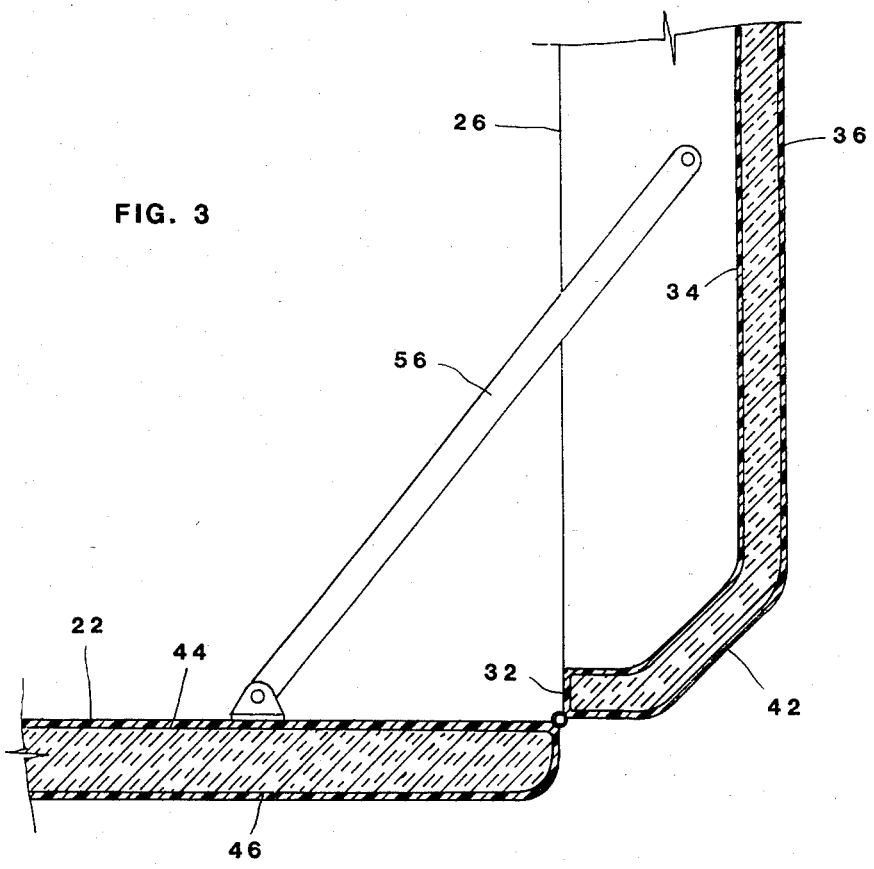
FIG. 3 is a partial elevation view in cross section showing details of a detachable side brace means.
Figure 4:
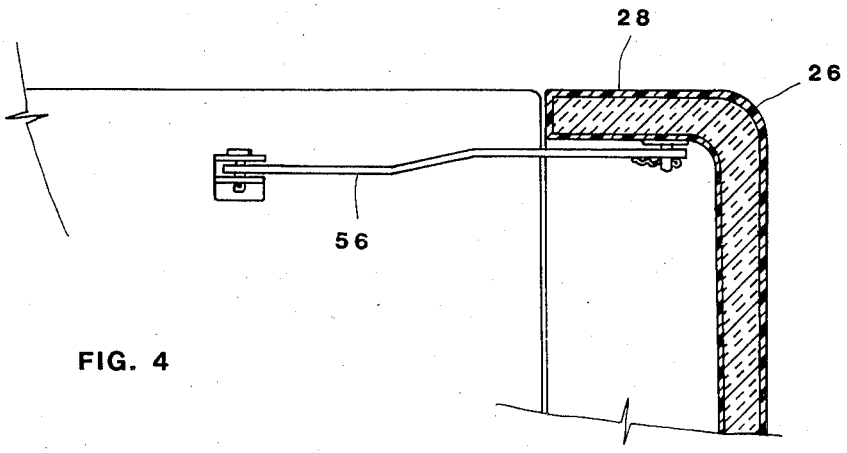
FIG. 4 is a partial end elevation view in cross section showing additional details of the brace means of FIG. 3.
Figure 5:
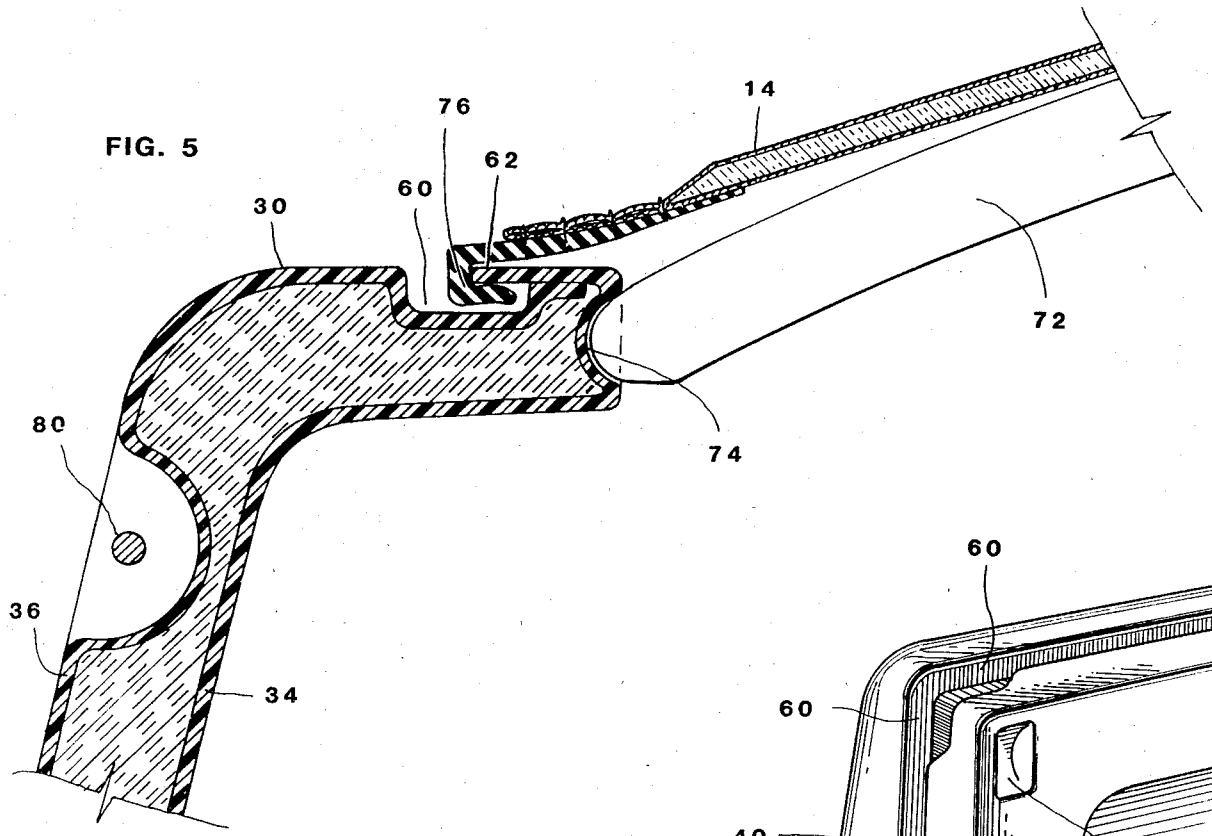
FIG. 5 is a partial cross section taken through the connection area of the roof and side wall showing additional details of construction.
Figure 6:
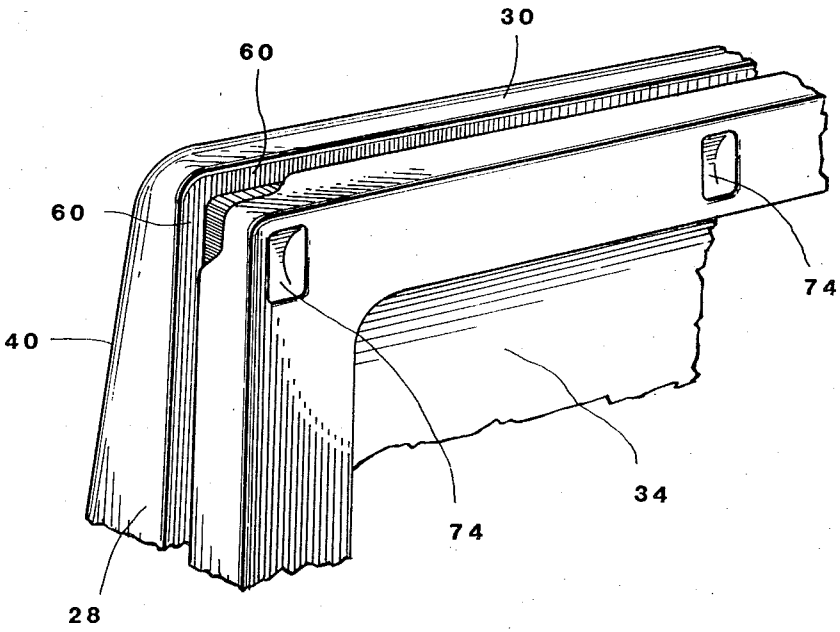
FIG. 6 is a partial view in perspective showing details of the edge of a modular unit and illustrating groove means therein for receiving weather stripping.

FIGS. 5 and 6 show details of mounting the roof on the structure beginning with the folding type roof beams or joists 72. The beams 72, as illustrated in FIGS. 2, 5, 6, 12 and 13, are arcuate members having two sections which are pivotally secured to each other for easy storage as seen in FIG. 2 and which can be folded out as seen in FIGS. 12 and 13 during the erecting steps. It is to be understood that the roof beams or joists may also be of a telescoping type or otherwise collapsible for easy assembling of the structure. The top edge of the units 12 is provided with a series of spaced apart sockets 74 with a curved concave shape to receive the curved ends of beams 72. The roof blanket 14 is a flexible or semi-rigid matt also with a high "R" value insulation between flexible sheets. Roof blanket 14 is 1 to 2 inches in thickness and is stretched over beams 72 and held in place by continuous hook means 76 extending along each of the two ends thereof. The hook is attached to the blanket as by sewing or other appropriate means. FIG. 2 illustrates that roof blanket 14 can be rolled up to fit into the interior of the unit along with folded beams 72 when it is collapsed for transport.

Figure 9:
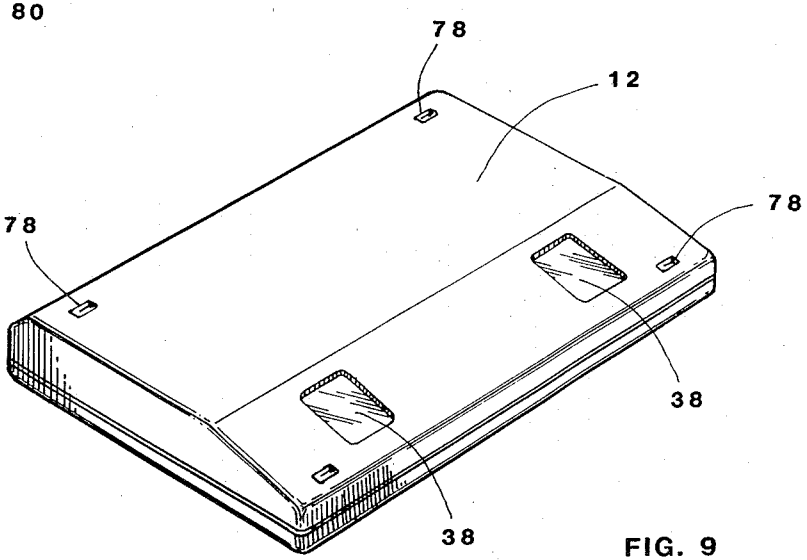
FIG. 9 is a view in perspective showing a unit in its collapsed or folded state.

FIG. 9 shows the unit collapsed and that four, or more, recessed tie down pieces of hardware 78 with bar 80 are provided near each of the outside four corners of the side wall portion of the unit 12. Thus guy ropes 20 can be quickly and conveniently attached to lend stability to the structure.

FIGS. 10 through 15 illustrate the steps involved in erecting the shelter structure and further show the ease and convenience for the persons doing the assembling. Two modular units 12 are positioned together and opened. The two floor sections 22 are joined after which the side wall 28 is raised and secured with knee brace 56. The opposing side wall is then raised, beams 72 and roof blankets 14 are spread and secured between the tops of opposing side walls. Finally end blankets 16 and vestibules 18 are attached. It will be apparent that the structure 10 can be assembled with as many pairs of modular units 12 as are needed.

Figure 16:
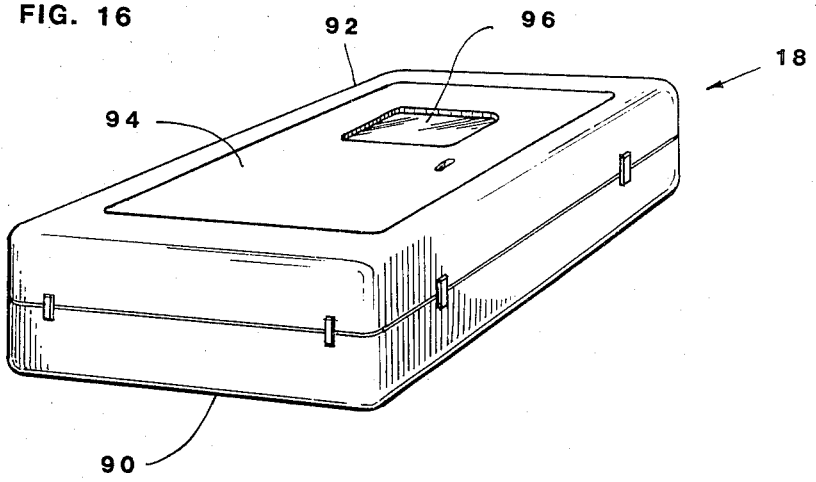
FIG. 16 shows the vestibule unit in its collapsed state and functioning as a transport container.
Figure 17:
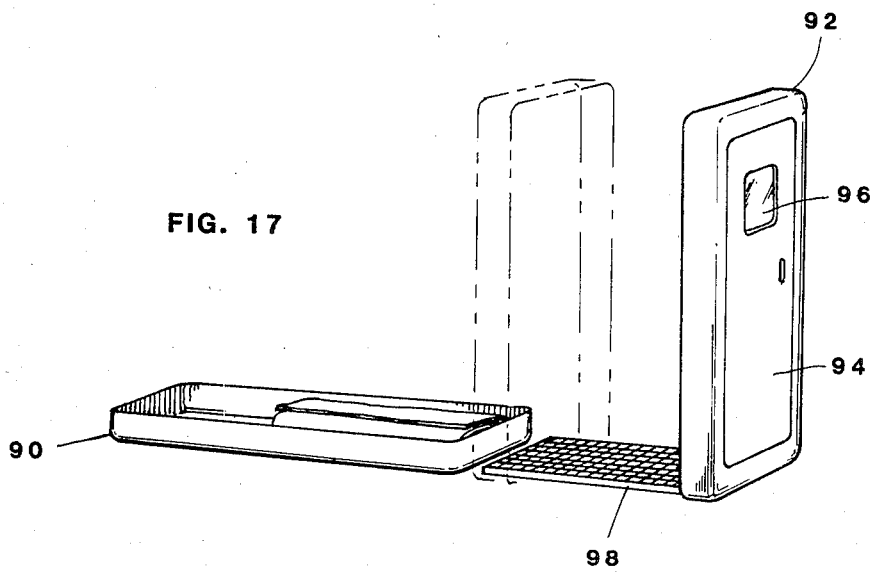
FIG. 17 is a view illustrating the vestibule unit opened and the two ends of the vestibule separated.

FIGS. 16 and 17 show details of the vestibule unit 18 which includes rectangular, box shaped end sections 90 and 92, one of which will have an entrance door 94 with port or window 96. The end sections are separated and an enclosure blanket 100 is mounted between them preferably on purlins or other supporting frame means extending between the two sections. A mat or grate floor 98 is provided between the two sections. Blanket 100, purlins (not shown), mat and any other parts are transported in the container in its collapsed state as shown in FIG. 16.

Figure 18:
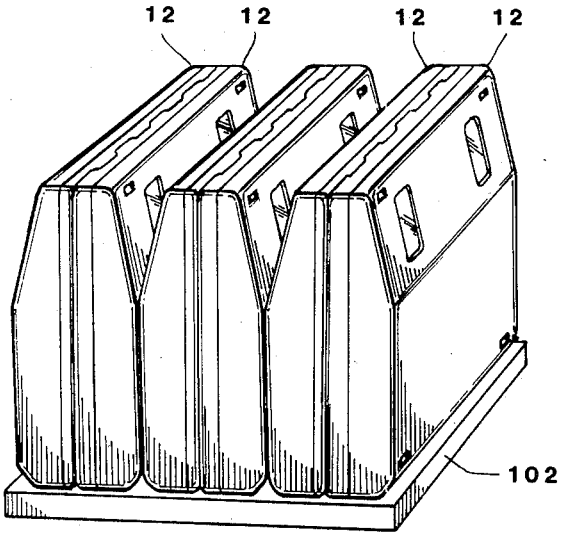
FIGS. 18–20 illustrate the convenient cargo and shipping advantages of the modular units.
Figure 19:
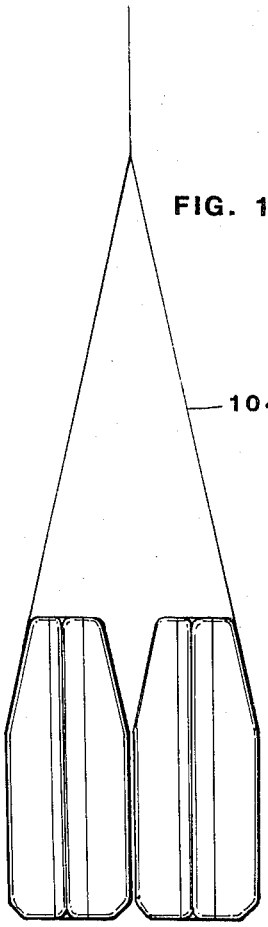
Figure 20:
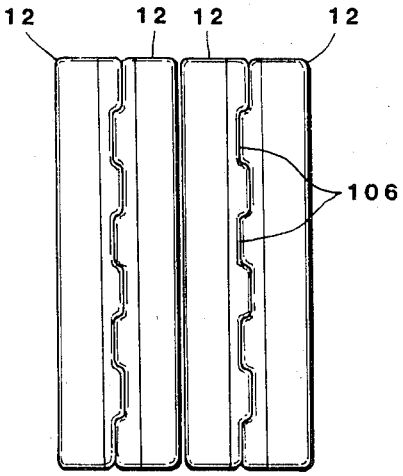

FIGS. 18–20 have been added to illustrate that the design of the structure is such that basic modular units 12 form a shipping container which can be handled on pallets 102 or cargo slings 104. If desired the floor sections may be serrated or saw tooth shaped as at 106 in order to allow floor sections to more easily overcome slight irregularities in the terrain and also so that adjoining pairs of units 12 do not slip with respect to each other when stacked for shipping. In respect of the materials used in the floor and side wall sections, and example of the foam core would be a polyvinylchloride foam and the shell material could be reinforced polyester resin.

We claim:

1. A collapsible, self-storing, portable building system, comprising:

(a) substantially identical, collapsible modular floor and sidewall units for use in pairs, each of said modular units being generally rectangular and including a generally flat, planar and rigid floor section and a rigid sidewall section, said floor section and said sidewall section being hingedly attached to each other along adjacent edges and allowing said sidewall section to be pivotally rotated from a closed position in which the perimeters of said floor and sidewall sections are generally coincident and engageable with each other, to an open and upright position relative to its related floor section, said sidewall section having inwardly extending edge walls around its periphery such that an inside surface is formed to define a storage cavity between said floor and sidewall sections when their respective peripheries are engaged, said pairs of modular floor and sidewall sections in their open and upright position being detachably connected to each other along their abutting edges for holding said pairs securely together, (b) removably attachable and collapsing roof members adapted to be secured to and between the tops of said pairs of sidewall sections and to be stored in said storage cavity, and (c) collapsible and attachable end wall sections adapted to be secured to the ends of said modular units and including door means.

2. The building system according to claim 1 and wherein said roof members include a plurality of collapsible roof beams which are adapted to be detachably secured in spaced apart relationship to and between the tops of said sidewall sections, and wherein said roof members further include a roof covering which attaches to the tops of said pair of sidewall sections and is supported on said beams.

3. The building system according to claim 1 and wherein substantially continuous groove means are provided in the outer peripheries of said modular units on the outer surfaces thereof to receive weather stripping material to seal the inside of said shelter structure to the outside.

4. The building system according to claim 1 and wherein attachment means are provided for joining the ends of abutting pairs of modular units.

5. The building system according to claim 1 and wherein a collapsible vestibule unit is adapted to be secured to an end wall section, said vestibule unit forming a closed space exterior to the door in an end wall and including floor means therein.

6. The building system according to claim 2 and wherein substantially continuous groove means are provided in the outer peripheries of said modular units on the outer surfaces thereon to receive weather stripping material to seal the inside of said shelter structure to the outside.

7. The building system according to claim 6 and wherein attachment means are provided for joining the ends of abutting pairs of modular units.

8. The building system according to claim 7 and wherein a collapsible vestibule unit is adapted to be secured to an end wall section, said vestibule unite forming a closed space exterior to the door in an end wall and including floor means therein.

* * * * *